US005529079A

United States Patent [19]

Tu

[11] Patent Number: 5,529,079

[45] Date of Patent: Jun. 25, 1996

[54] STRUCTURE OF A CIGARETTE FILTER AND ITS RECEPTACLE

[76] Inventor: Ching C. Tu, 5F1., No. 8, Alley 22, Lane 44, Ba An St., Hsin Tien, Taiwan

[21] Appl. No.: 264,096

[22] Filed: Jun. 21, 1994

[51] Int. Cl.[6] ..... A24F 13/18

[52] U.S. Cl. ..... 131/175; 131/237

[58] Field of Search ..... 131/329, 256, 131/175, 237, 330

[56] References Cited

U.S. PATENT DOCUMENTS 1,594,606 8/1926 Clivio ..... 131/330

4,660,575 6/1987 Anderson et al. ..... 131/256

*Primary Examiner*—V. Millin

*Assistant Examiner*—Charles Anderson

[57] ABSTRACT

An improved structure of a cigarette filter and its receptacle, wherein several filters cap one another in the receptacle having the same length as that of a cigarette and stored in a cigarette box for convenient use and carrying; a port for loading or taking a filter is provided on the top of the receptacle, a flange is provided on the inner side of the port for abutting against a convex annular portion on the bottom external side of a cigarette seat of a filter, thus prevents the filter from dropping inadvertently; a clip for clamping on a cigarette box or a pocket like a clip on a pen cap is provided on the upper portion of the receptacle, the bottom of the receptacle is formed as a sucking piece on the filter such that the receptacle can receive more filters therein and has a more beautiful appearance.

1 Claim, 4 Drawing Sheets

STRUCTURE OF A CIGARETTE FILTER AND ITS RECEPTACLE

BACKGROUND OF THE INVENTION

1. Field of the Invention

The present invention relates to an improved structure of a cigarette filter and its receptacle, and especially to that wherein several filters can be received serially in a straight pipe like receptacle having the same length as that of a cigarette and cap one another, they can be put in a cigarette box so as to be convenient for use and carrying.

2. Description of the Prior Art

People sujected to detriment of cancerogenic material such as tar and nicotine in cigarette by smoking gradually increases in amount due to hurry advance of industry and commerce which make life more nervous and busy. According to reports of medicine studies, if people who do not smoke exposes to smoke made by smokers frequently, the rate of canceration of them is several times as comparing to that of the smokers, hence the motion of "refusing second hand smoking" has formed an international tide of movement in these years. The smokers who are deeply addicted to smoking have to take care not to hurt the people near them although they can not help smoking. And there are people who invent various cigarette filters in order to reduce detriment of cigarettes to human body to the minimum degree.

Conventional cigarette filters are lined in a receiving box having no any attached device, the volume of the box is large and unconvenient for carrying, the cigarettes therein are not easy to be loaded in or taken out, a receptacle of pen type having a clip on its cap has been developed, such as shown in FIG. 5. Such known pen type receptacle is divided into two sections, at the connection of the sections, there may be a flange for fitted combination of these sections, or there is a threaded portion as depicted in FIG. 5 for screwing connection, a clip A is provided on one side of the upper section, the configuration of the cigarette filter B is a straight pipe with a converged flat rectangular portion having a sucking piece B1, after the cigarette filter B is inserted in the pen type receptacle, the receptacle may clamp on a pocket of a shirt by the clip A for carrying or for use. However, the conventional cigarette filters and their pen type receptacles have the following disadvantage:

1. The conventional pen type receptacles are much longer than the cigarettes and hence can not be stored in a cigarette box, and must be carried separately, they are subjected to being forgotten and not to be carried.
2. The conventional pen type receptacles are each divided into two sections, the cigarettes therein are not easy to be loaded in or taken out, yet the shaft of each receptacle is very thick and will make a user uncomfortable when it is used to clamp on a pocket.
3. The cigarette seat and the bottom end of the sucking portion on each of the conventional cigarette filters have the same width (diameter), therefore, they can not cap one another, yet the amount of the cigarettes that each conventional pen type receptacle can hold is very limited.

SUMMARY OF THE INVENTION

The primary object of the present invention is to provide an improved structure of a cigarette filter and its receptacle, wherein a plurality of filters can cap one another in a pen type receptacle having the same length as that of a cigarette, and can be stored in a cigarette box for convenient use and carrying.

Another object of the present invention is to provide a port on the shaft of the receptacle for loading and taking cigarette filters, thus the trouble of turning off a cap of the receptacle firstly and then loading or taking cigarette filters can be saved. And a small flange is provided on the inner side of the port for abutting against a convex annular portion on the bottom external side of a cigarette seat of a cigarette filter, thus can prevent the cigarette filter from dropping inadvertently.

A further object of the present invention is to provide on the upper portion of the shaft of the receptacle a clip for clamping on a cigarette box or a pocket on a shirt like a clip on a cap for a pen, the bottom end of the shaft is formed as a sucking piece of a cigarette filter, the receptacle is capable of receiving more filters therein and can have a more beautiful appearance.

The present invention will be apparent in re the realistic structure, characteristics and functions thereof after reading the detailed description of the preferred embodiment thereof in reference to the accompanying drawings.

DETAILED DESCRIPTION OF THE PREFERRED EMBODIMENT

Figure 1:
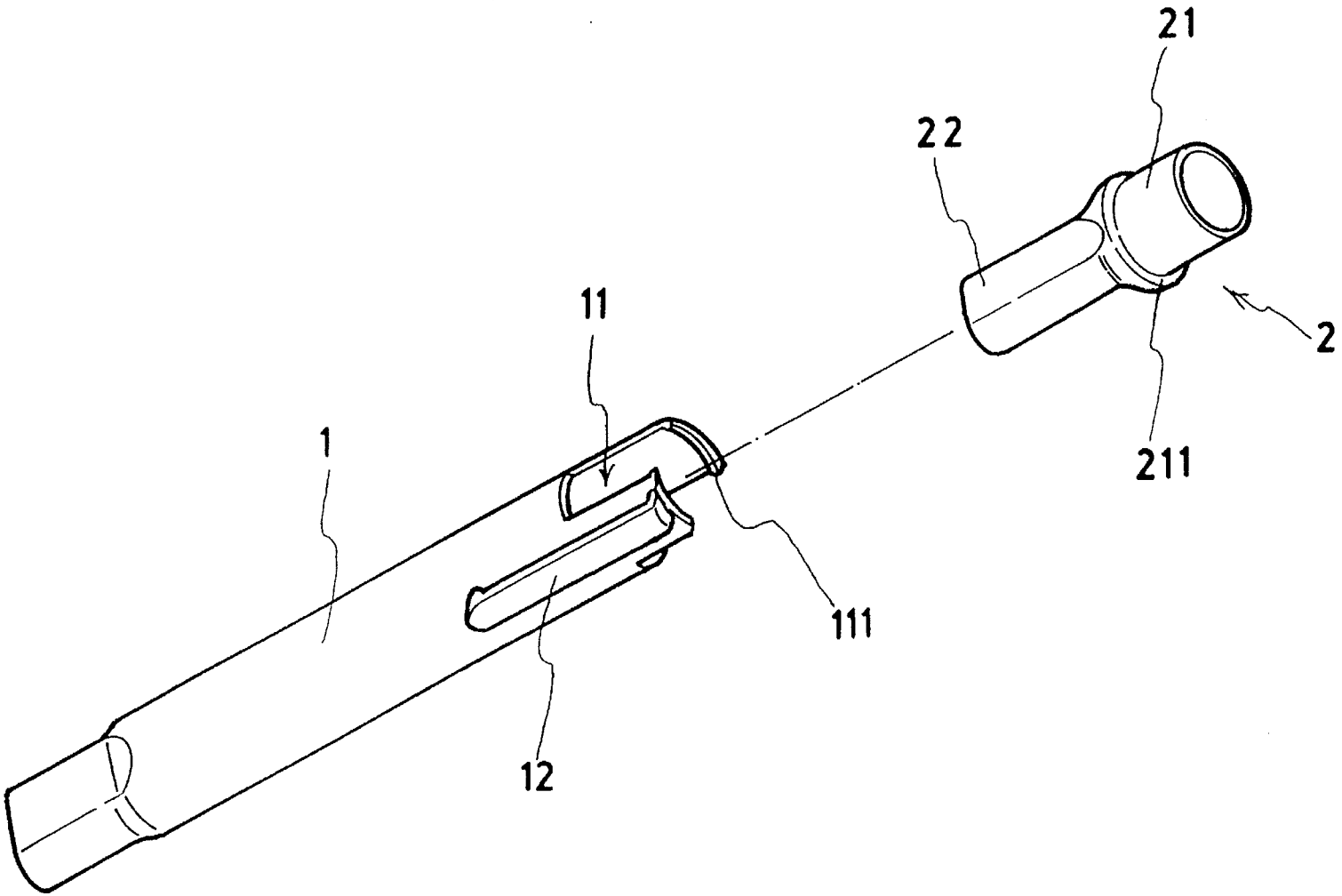
FIG. 1 is a perspective view of a cigarette filter and its receptacle of the present invention.
Figure 5:
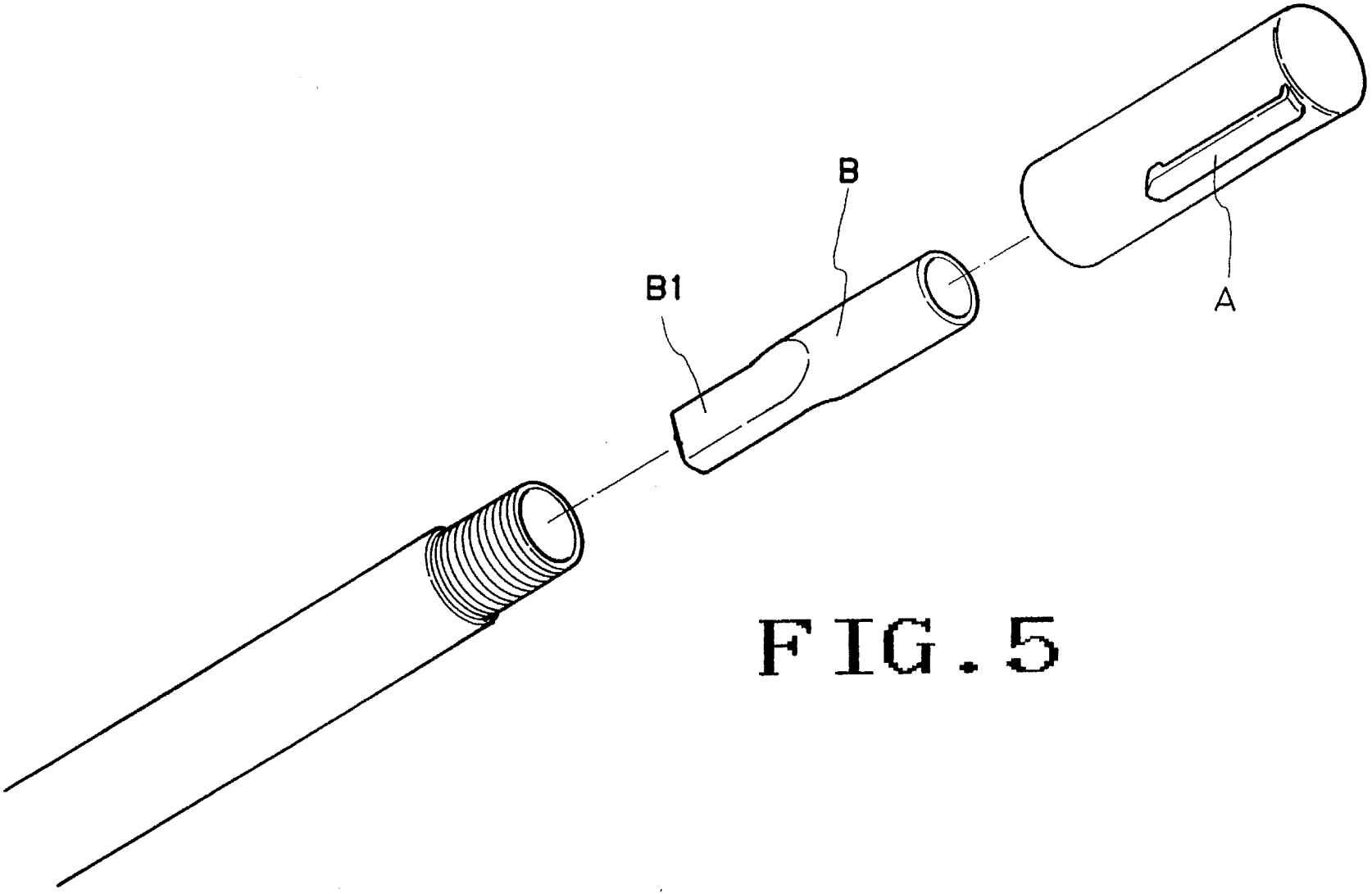
FIG. 5 is an anatomic perspective view of a conventional cigarette filter and its receptacle.

As shown in FIG. 1, the receptacle 1 for the cigarette filters of the present invention is made of a material having high elaticity and tenacity, and is formed as a hollow stright pipe, the length thereof is almost the same as that of a cigarette, the diameter thereof can allow it to fittedly receive a plurality of cigarette filters 2 therein, a port 11 for loading or taking a cigarette filter 2 is provided on the top end of the receptacle 1, a small flange 111 is provided on the inner side of the port 11 for abutting against a convex annular portion 211 on the bottom external side of a cigarette seat 21 of a cigarette filter 2, thus can prevent the cigarette filter 2 from dropping inadvertently. A clip 12 like a clip on a cap of a pen is provided on the upper portion of the shaft of the receptacle 1, thereby the receptacle 1 can clamp on a cigarette box or a pocket of a shirt, the bottom end of the shaft of the receptcle 1 is formed as a sucking piece 22 of a cigarette filter 2, the receptacle 1 is capable of receiving more filters 2 therein and can have a more beautiful appearance; Besides, the shape of the cigarette filters 2 is an improvement as compared to the conventional cigarette filter B shown in FIG. 5, and is in a shape of a straight pipe and of which the lower end is converged in a degree larger than that of the converged end of a conventional cigarette filter to form a flat rectangular portion, the sucking piece 22 thereon has a diameter or width smaller than the diameter of the cigarette seat 21 and thus can be inserted in the cigarette seat 21, the number of cigarette filters that the receptacle 1 can accept can be increased to 5, a convex annular portion 211 is provided on the bottom external side of the cigarette seat 21 of a cigarette filter for abutting against a small flange 111 which is provided on the inner side of the port 11 of the receptacle 1 to prevent the cigarette filter from dropping inadvertently.

Figure 2:
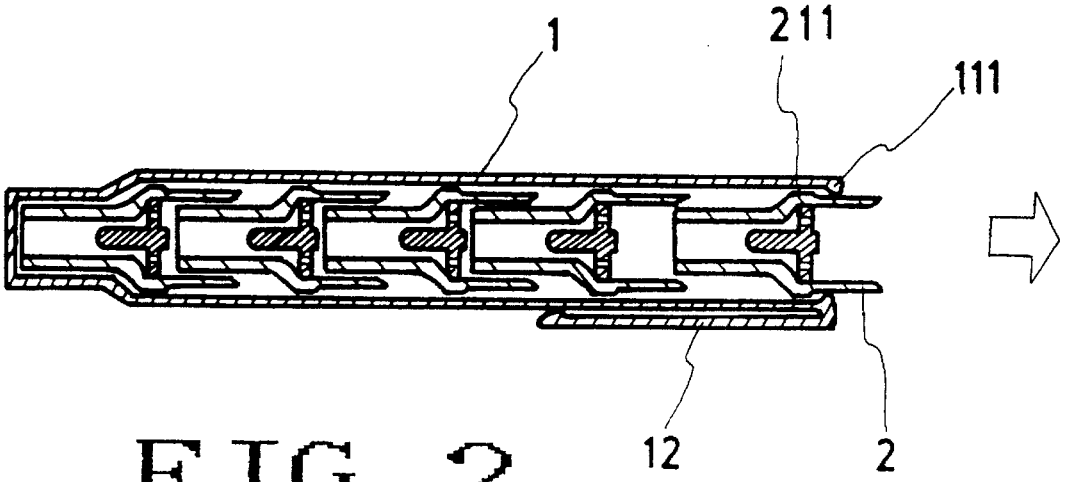
FIG. 2 is a sectional schematic plan view of the present invention.
Figure 3:
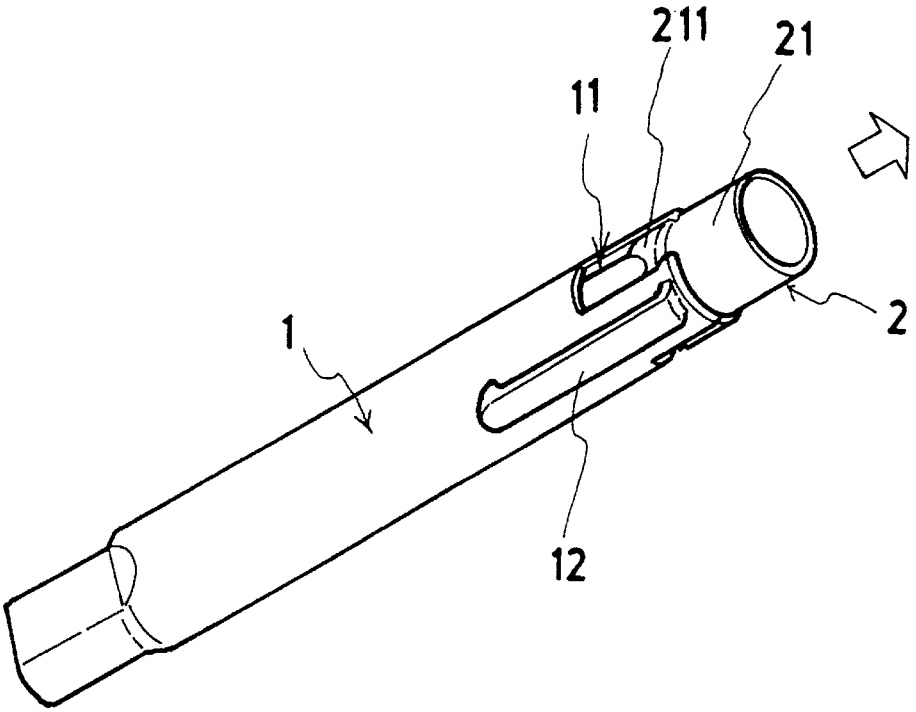
FIG. 3 is a perspective schematic view of the present invention.

FIG. 2 is a sectional schematic plan view of the present invention, it can be seen in the drawing that the receptacle 1 in a shape of a straight pipe can certainly receive 5 cigarette filters 2, the lower end of the receptacle 1 is provided with a chamber having the shape as that of a cigarette filter 2, this may help the cigarette filters 2 fit well in the receptacle 1 without any collission or noise when being shaked, and the receptacle 1 can have a more beautiful appearance, yet the user can feel convenience in use for the advantage stated below. The structure of the receptacle 1 has the character of elasticity and toughness because of the material it is made of; The port 11 for loading or taking a cigarette filter 2 provided on the top end of the receptacle 1 has a small flange 111 provided on the inner side thereof for abutting against the convex annular portion 211 on the bottom external side of the cigarette seat 21 of a cigarette filter 2, thus can prevent the cigarette filter 2 from dropping inadvertently. However, when it is desired to take a cigarette filter 2, it needs only to pull a cigarette filter 2 out of the port 11 with fingers in pursuance of the arrow shown in FIG. 3, while if it is desired to load a cigarette filter 2, it needs only to do in a contrary procedure as just stated, and the trouble of turning off a cap of the receptacle firstly and then loading or taking cigarette filters can be saved, nevertheless, the cigarette filters 2 therein have no way to drop inadvertently.

Figure 4:
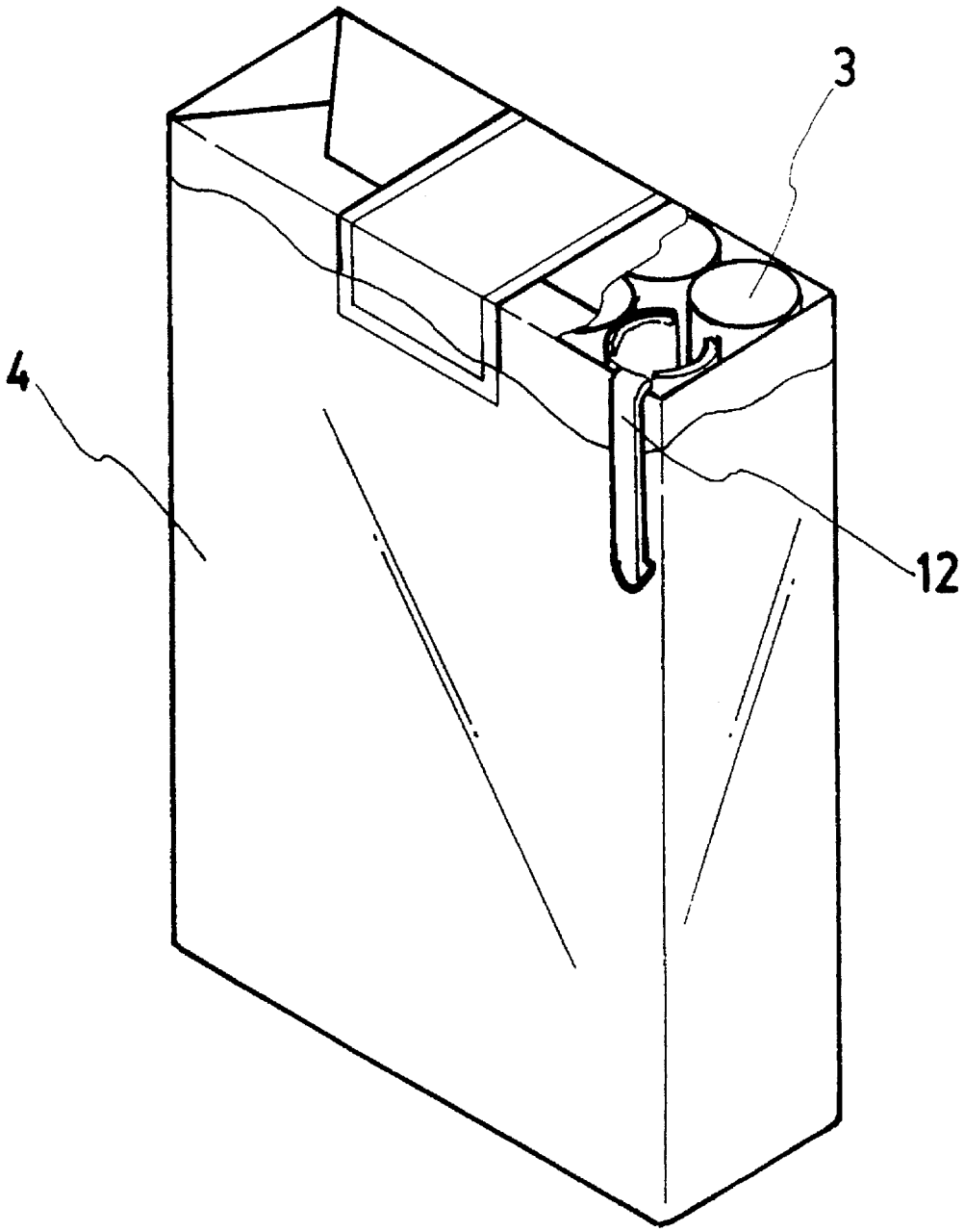
FIG. 4 is a schematic view showing the present invention in use.

Referring to FIG. 4, the straight pipe-like receptacle 1 of the present invention has the length as that of a cigarette, while the diameter thereof is smaller than that of a conventional receptacle, it can thereby stored in a cigarette box 4 with the cigarettes 3 therein, and it can clamp on the cigarette box 4 by means of the clip 12, in this way, a cigarette filter 2 will not be subjected to being forgotten or not to be taken when a cigarette is to be used.

According to the statement of the structural character and technical content of the present invention, it has therefore the following advantage:

1. The appearence of the receptacle of the present invention is neater, more beautiful and more tasty than that of a conventional receptacle, the size of the shaft thereof is well designed to allow it to insert in a cigarette box having no plenty of room or in a pocket without an uncomfortable feeling to the user.
2. The unique configuration design of the cigarette filters of the present invention can allow the sucking portion of a cigarette filter to be inserted in the cigarette seat of another cigarette filter, so that the amount of the cigarettes that the receptacle can hold is much more than that a conventional receptacle can hold.
3. The receptacle of the present invention is designed to be an open style, a port 11 for loading or taking a cigarette filter is provided on the top end of the receptacle, and a small flange is provided on the inner side of the port for abutting against a convex annular portion on the bottom external side of a cigarette seat of a cigarette filter, thus can prevent the cigarette filter from dropping inadvertently, therefore, the trouble of turning off a cap of the receptacle firstly and then loading or taking cigarette filters can be saved.

My invention may assume numerous forms and is to be construed as including all modifications and variations falling within the scope of the appended claims.

I claim:

1. A cigarette filter and holder device comprising:

a cylindrical receptacle that receives a plurality of filtering means in serial fashion in a central cavity of said receptacle a plurality of filtering means in serial fashion provided in said central cavity of said receptacle, said receptacle being of the same length as a cigarette so that said device may be easily stored in a cigarette package, said receptacle including at a first end thereof a port for loading and unloading said filtering means, said port including a flange on an inner side thereof, said filtering means including a convex annular portion that abuts said flange of said port so that a terminal filtering means is securely seated in said port.

* * * * *